United States Patent [19]

Svendsgaard

[11] Patent Number: 4,466,188

[45] Date of Patent: Aug. 21, 1984

[54] ROOFING REMOVER

[75] Inventor: Roger W. Svendsgaard, Fergus Falls, Minn.

[73] Assignee: Albin H. Morrill, Fergus Falls, Minn. ; a part interest

[21] Appl. No.: 460,608

[22] Filed: Jan. 24, 1983

[51] Int. Cl.[3] ..... A47L 13/02

[52] U.S. Cl. ..... 30/172; 254/131.5; 30/277

[58] Field of Search ....., 29/254, 255, 239; 30/169, 172, 277; 145/1 A, 61 J; 294/54; 254/131, 131.5, 104

[56] References Cited

U.S. PATENT DOCUMENTS

| | | | |
|---|---|---|---|
| 776,191 | 11/1904 | Lynch | 30/277 |
| 1,218,145 | 3/1917 | Whittier . | |
| 1,527,561 | 2/1925 | Klum | 30/169 |
| 2,162,117 | 6/1939 | Perry | 145/61 J |
| 2,195,667 | 4/1940 | Baker . | |
| 2,482,805 | 9/1949 | Stafford . | |
| 2,485,877 | 10/1949 | Hamilton | 30/277 |
| 2,680,003 | 6/1954 | Feinstein . | |
| 2,754,585 | 7/1956 | Green | 30/277 |
| 3,061,928 | 11/1962 | Waters et al. | 30/169 |
| 3,568,657 | 3/1971 | Gue . | |
| 3,696,873 | 10/1972 | Anderson . | |
| 3,712,389 | 1/1973 | Smoak . | |
| 3,818,593 | 6/1974 | Oliverius | 30/169 |
| 4,009,743 | 3/1977 | Ackerman | 30/169 |
| 4,086,699 | 5/1978 | Olkkola | 254/131.5 |
| 4,203,210 | 5/1980 | Hadlick | 254/131.5 |
| 4,241,795 | 12/1980 | Landry . | |
| 4,324,042 | 4/1982 | Lipka et al. | 254/131.5 |

*Primary Examiner*—Robert C. Watson

*Attorney, Agent, or Firm*—Harvey B. Jacobson

[57] ABSTRACT

A wedge head is provided having upper and lower surfaces and front and rear ends. The upper and lower surfaces are forwardly convergent toward a forward transverse apex edge of the head and an elongated handle is provided including base and free end portions. The handle base end portion is anchored relative to the head with the handle free end portion projecting rearwardly from the rear end of the head. A weight body is slidably mounted on the free handle end portion for guided reciprocation between front and rear limit positions on the handle and the wedge head includes front-to-rear extending opposite side surfaces which are rearwardly convergent. The side surfaces are also upwardly convergent and the forward transverse apex edge includes structure defining transversely spaced forwardly projecting teeth.

4 Claims, 8 Drawing Figures

Fig. 1
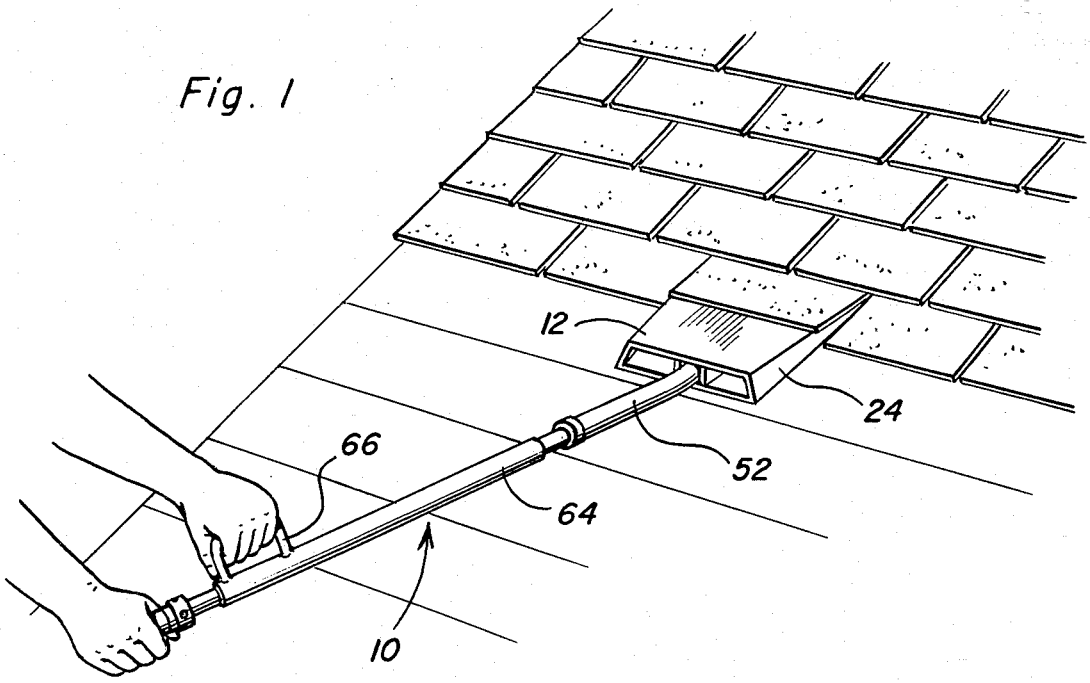
Fig. 5
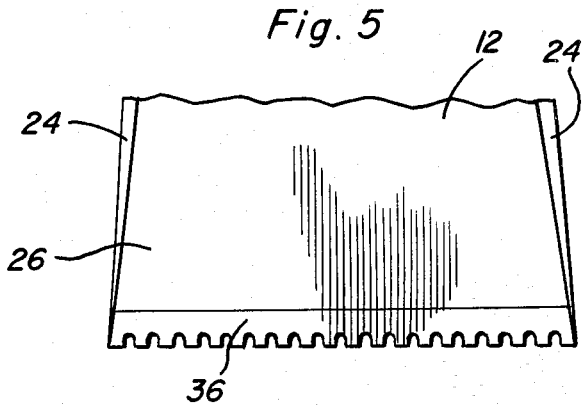
Fig. 2
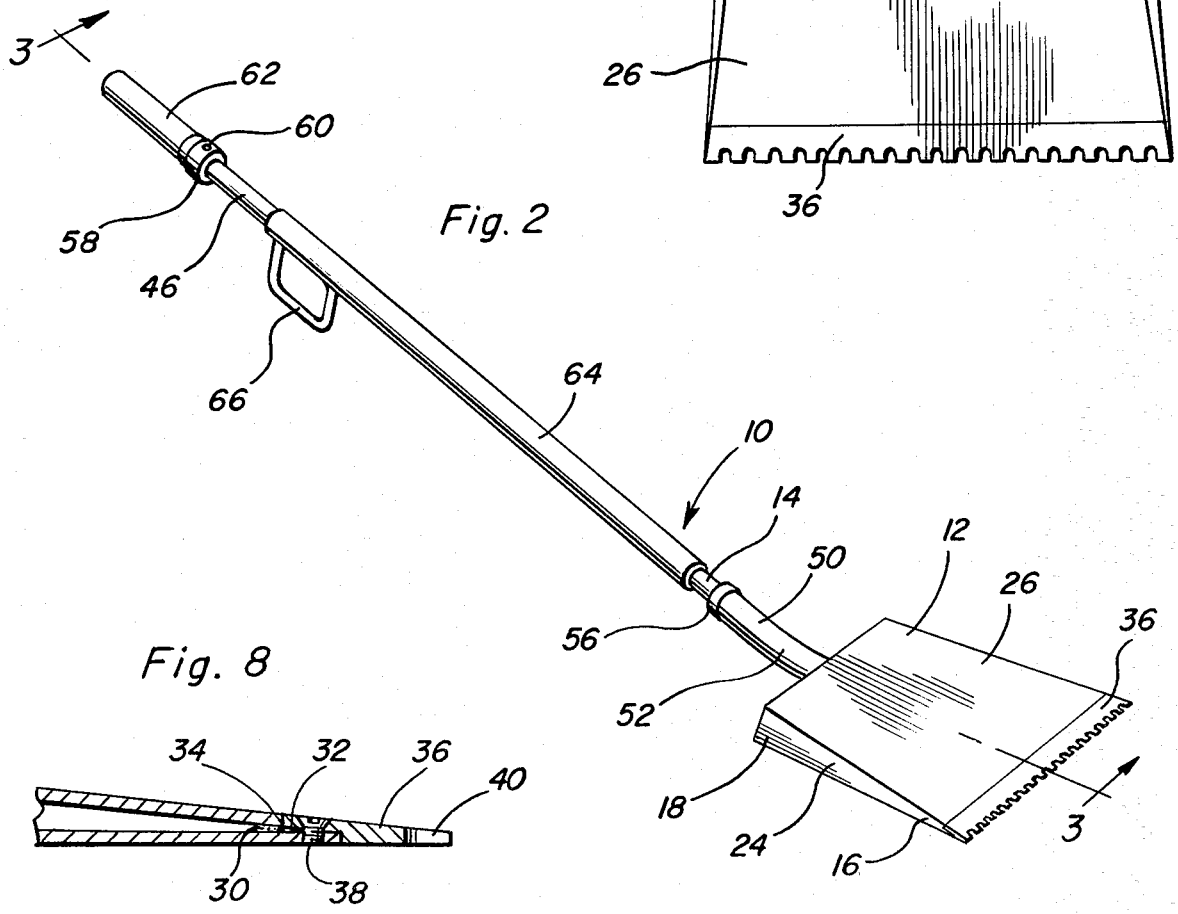
Fig. 8

10
12
14
16
18
20
22
24
26
28
42
44
46
48
50
52
54
56
58
60
62
64
66
7
4

ROOFING REMOVER

BACKGROUND OF THE INVENTION

Various tools heretofore have been provided for removing old shingles from a roof preparatory to the installation of new replacement shingles. Some shingle removing tools include generally planar work-engaging heads carried by elongated handles which may be manually manipulated to drive the planar heads beneath shingles for the purpose of severing the nails which secure the shingles to the roof. In addition, the handles are supported from the planar heads at an angle whereby the handles may be used as a lever in order to pry shingles from a roof. However, many roofing removing tools of this type are less efficient than desired for various reasons. Accordingly, inasmuch as roofing shingle removal is a difficult, tiring and dangerous task, a need exists for a roofing removing tool which will enable a roofer to remove roofing shingles in a more efficient, less tiring and safer manner.

Examples of roofing removers including some of the general structural and operational features of the instant invention are disclosed in U.S. Pat. Nos. 776,191, 1,218,145, 2,195,667, 2,482,805, 2,680,003, 3,568,657, 3,712,389, 3,696,873 and 4,241,795.

BRIEF DESCRIPTION OF THE INVENTION

The roofing remover of the instant invention includes a wedge-shaped head defining rearwardly convergent upper and lower surfaces and including opposite side surfaces which are rearwardly convergent. The head is supported from one end of an elongated handle projecting rearwardly from the rear of the head and disposed at an approximately 35° rearward and upward inclination relative to the under or lower surface of the head. A slide hammer sleeve is slidably mounted on the handle between abutments carried thereon for limiting forward and rearward movement of the slide hammer sleeve relative to the handle and the forward apex edge portion of the head is provided with forwardly projecting blunt teeth spaced transversely therealong.

The main object of this invention is to provide a roofing removing tool which will be capable of removing roofing shingles in an efficient and safe manner.

Another object of this invention is to provide a roofing removing tool of the wedge type and including an elongated handle equipped with a slide hammer whereby accurate placement of the head of the tool may be accomplished independent of slide hammer operation thereof.

Still another important object of this invention is to provide a roofing remover which may be readily wedged beneath roofing shingles and utilized to pry roofing shingles from a roof.

A further object of this invention is to provide a roofing remover including a forward edge designed for pulling and shearing roofing nails but constructed in a manner whereby gouging of uneven roof boads will be maintained at a minimum.

A final object of this invention to be specifically enumerated herein is to provide a roofing remover in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the roofing remover of the instant invention operatively associated with roofing shingles to be removed;

FIG. 2 is a perspective view of the roofing remover;

FIG. 5 is a fragmentary enlarged top plan view of the forward end of the head portion of the tool;

FIG. 8 is an enlarged fragmentary vertical sectional view illustrating the manner in which a removable apex edge member may be supported from the head of the tool.

DETAILED DESCRIPTION OF THE INVENTION

Figures 3, 4, 6, 7:
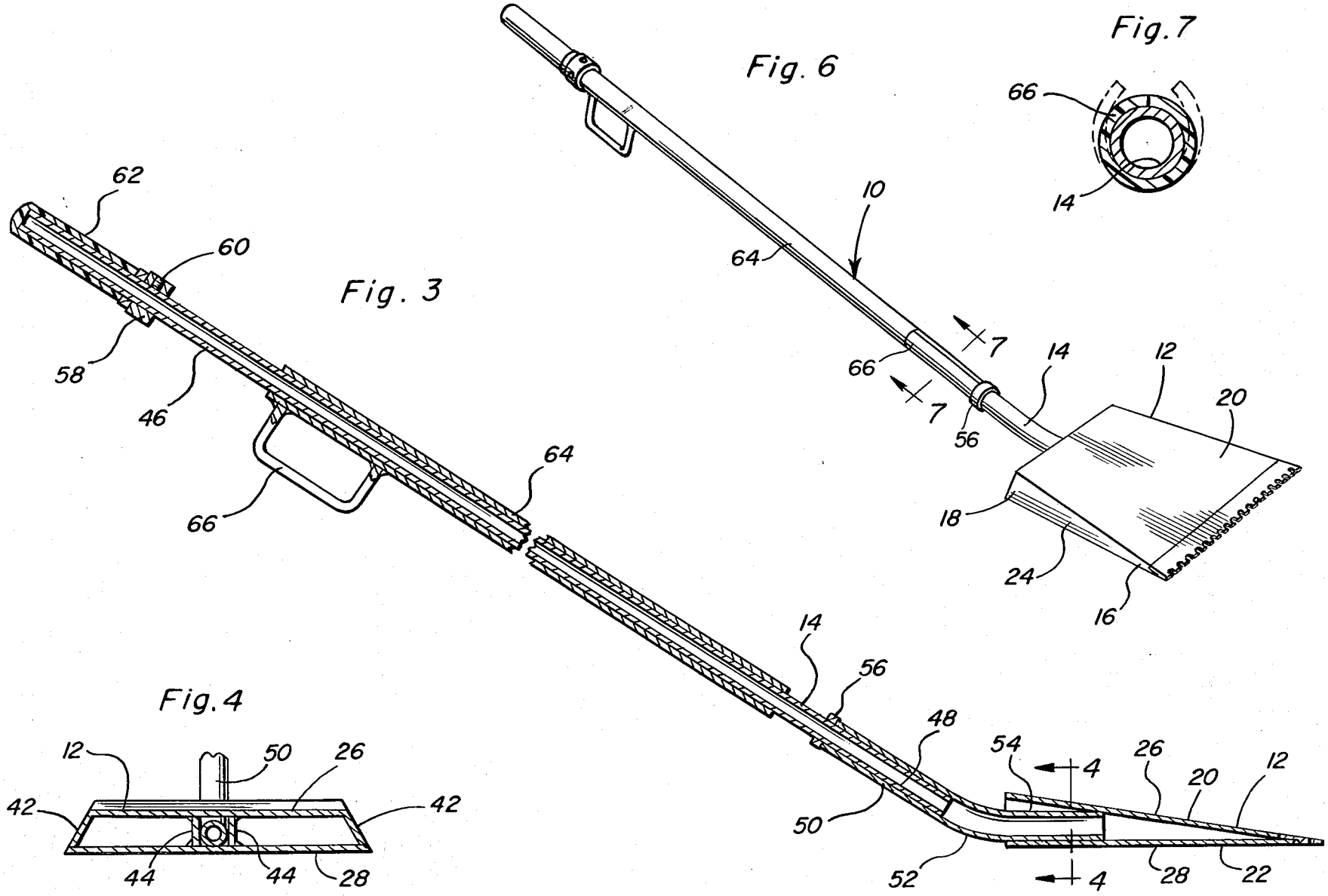
FIG. 3 is an enlarged longitudinal vertical sectional view taken substantially upon the plane indicated by the section line 3—3 of FIG. 2.
FIG. 4 is a transverse sectional view taken substantially upon the plane indicated by the section line 4—4 of FIG. 3.
FIG. 6 is a perspective view of the roofing remover with a resilient spacing sleeve interposed between one end of the hammer sleeve and the opposing abutment.
FIG. 7 is an enlarged transverse sectional view taken substantially upon the plane indicated by the section line 7—7 of FIG. 6.

The roofing remover of the instant invention is referred to in general by the reference numeral 10 and includes a head 12 and a handle 14. The head 12 includes front and rear ends 16 and 18, top and bottom surfaces 20 and 22 and opposite side front-to-rear extending surfaces 24. The surfaces 20 and 22 are forwardly convergent and are defined by top and bottom walls 26 and 28. The forward marginal edges of the top and bottom walls 26 and 28 are secured together by welding 30, see FIG. 8, and the forward marginal edge of the head 12 defines a forwardly and upwardly opening relieved area 32 in which the rear marginal edge 34 of a removable apex edge member 36 is secured through the utilization of removable threaded fasteners 38. The apex edge member 36 includes blunt forwardly projecting teeth 40 spaced therealong for pulling or shearing the upper ends of roofing nails. The teeth 40 are blunt in order to minimize gouging of uneven roofing boards.

The top and bottom walls 26 and 28 are rearwardly divergent and the opposite side surfaces 24 are defined by opposite side walls 42 extending between corresponding side marginal edges of the top and bottom walls 26 and 28. The side walls 42 are upwardly convergent as may best be seen from FIG. 4 of the drawings and the longitudinal mid-portions of the top and bottom walls 26 and 28 are stiffened relative to each other through the utilization of a pair of forwardly tapering stiffening plates 44 spaced apart transversely of the head 12 and secured to the top and bottom walls 28 in any convenient manner such as by welding.

The handle 14 includes a free end portion 46 and a base end portion 48. The base end portion 48 is secured within a tubular neck 50 defined by one end portion of a tubular fitting 52 having its other end portion 54 secured between the plates 44 and the top and bottom walls 26 and 28. The tubular fitting 52 actually comprises a reinforcing extension of the base and portion 48 of the handle 14 and it may be appreciated from FIG. 3 of the drawings that the rear marginal edge of the bottom wall 28 defines a fulcrum edge about which the tool 10 may be pivoted when the handle 14 has its free end portion 46 swung downwardly while the bottom surface 22 of the head 12 rests upon a horizontal surface.

The base end portion 48 includes a radially outwardly projecting abutment collar 56 thereon abuttingly engaged with the free end of the tubular neck 50 and the free end portion 46 of the handle 14 includes a removable abutment collar 58 thereon held in position by a setscrew 60. The end portion of the handle 14 which projects rearwardly beyond the abutment collar 58 has a tubular handgrip 62 mounted thereon.

A slide hammer sleeve 64 is slidably mounted on the handle 14 intermediate the collar 56 and the collar 58 and the sleeve 64 includes a bail-type handle 66. The sleeve 64 is further rotatable on the handle 14 whereby the tool 10 may be held in one hand and the sleeve handle 60 may be engaged by the other hand of a workman, independent of whether that workman is right or left handed.

As an accessory for the tool 10, a longitudinally split resilient sleeve 66 is provided, see FIGS. 6 and 7, and it may be laterally positioned about the handle 14 between the collar 56 and the sleeve 64 when the remote end of the sleeve 64 is abutted against the collar 58. In this manner, the split resilient sleeve 66 serves to prevent sliding movement of the hammer sleeve 64 on the handle 14.

In operation, the roofing remover 10 may be used in the manner illustrated in FIG. 1 of the drawings. The handle 14 is manipulated by a roofer to position the apex edge member 36 beneath the shingles to be removed. Then, the handle 66 and the slide sleeve 64 may be engaged and reciprocation of the sleeve 64 and its impacting against the collar 56 will be effected to drive the apex edge member 36 beneath the shingles to be removed. The nails retaining the shingles to be removed will be sheared by the apex edge member and the 35° angulation of the handle 14 relative to the bottom wall 28 enables the tool 10 to be used as a lever to pry the shingles from the roof upon which the tool 10 is being used.

The rearward tapering of the transverse width of the head 12 is important in that rearward displacement of the tool head 12 from beneath shingles being removed may be effected with ease and without the rear portions of the head catching on shingles which have not been loosened. Also, the rearward converging side walls 42 as well as their upward convergence enables the handle 14 to be more readily shifted to one side or the other when the head 12 is engaged beneath shingles to be removed in order to facilitate more ready pulling or shearing of shingle-retaining nails. Still further, although the apex edge member 30 has been illustrated and described as removable, it is to be understood that the apex edge member may comprise a continuation of the forward marginal edge of the top wall 26 and be permanently attached to the bottom wall 28.

When it is desired to drive the head 12 beneath shingles which are nailed down in the manner illustrated in FIG. 1 of the drawings, the hammer sleeve 64 is slid back and forth and impacted with the collar 56. Thus, the apex edge member 36 may wedge beneath the shingles to be removed and pull or shear the nails securing the shingles to the roofing. Further, the manually actuatable slide hammer sleeve may be replaced by an electrically, air, or fluid pressure operated hammer, if desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A roofing remover including a wedge head having upper and lower surfaces and front and rear ends, said upper and lower surfaces being forwardly convergent toward a forward transverse apex edge, a handle including base and free end portions, the base end portion of said handle being anchored relative to said head with the handle free end portion projecting rearwardly from said rear end of said head, the handle free end portion being rearwardly and upwardly inclined substantially 35° relative to said lower surface, said wedge head including forwardly tapering front-to-rear extending opposite side surfaces extending between said upper and lower surfaces, said side surfaces being rearwardly and upwardly convergent, said handle free end portion including an elongated weight body slidably mounted thereon for guided reciprocation back and forth along said free end portion, impact surface means on said handle engageable by said weight body to limit forward movement of said body relative to said handle, and a longitudinally split resilient sleeve removably snugly and laterally positionable about said handle between one end of said weight body and the opposing impact surface means.

2. The roofing remover of claim 1 wherein said forward transverse apex edge includes means defining transversely spaced forwardly outwardly projecting teeth spaced along said forward transverse apex edge.

3. The roofing remover of claim 2 wherein said forward transverse apex edge is defined by a replaceable apex member removably supported from the front end of said head.

4. The roofing remover of claim 1 wherein said weight body comprises a sleeve member rotatable on said handle about its longitudinal axis, said sleeve member including radially outwardly projecting handgrip means.

* * * * *